US008512018B2

(12) United States Patent
Jordan et al.

(10) Patent No.: US 8,512,018 B2
(45) Date of Patent: Aug. 20, 2013

(54) GEAR PUMP WITH PRESSURE RELIEF GROOVE

(75) Inventors: Martin Jordan, Duesseldorf (DE); Stephan Hoppe, Willich (DE); Juergen Floerchinger, Erkrath (DE)

(73) Assignee: TRW Automotive GmbH, Alfdorf (DE)

( * ) Notice: Subject to any disclaimer, the term of this patent is extended or adjusted under 35 U.S.C. 154(b) by 501 days.

(21) Appl. No.: 11/906,115

(22) Filed: Sep. 28, 2007

(65) Prior Publication Data

US 2008/0166254 A1 Jul. 10, 2008

(30) Foreign Application Priority Data

Sep. 28, 2006 (DE) ..... 20 2006 014 930 U

(51) Int. Cl.

| | |
|---|---|
| ***F01C 1/18*** | (2006.01) |
| ***F01C 1/24*** | (2006.01) |
| ***F01C 21/18*** | (2006.01) |
| ***F04C 2/18*** | (2006.01) |
| ***F04C 2/24*** | (2006.01) |
| ***F04C 15/06*** | (2006.01) |

(52) U.S. Cl.
USPC ..... 418/78; 418/75; 418/189; 418/206.4; 418/206.5

(58) Field of Classification Search
USPC ..... 418/205–206.9, 180, 189, 75, 78
See application file for complete search history.

(56) References Cited

U.S. PATENT DOCUMENTS

| | | | | |
|---|---|---|---|---|
| 1,719,025 | A * | 7/1929 | Scheminger, Jr. | 418/75 |
| 2,620,968 | A | 12/1952 | Nilsson | |
| 2,821,929 | A * | 2/1958 | Erick et al. | 418/75 |
| 3,113,524 | A * | 12/1963 | Fulton | 418/79 |
| 3,303,792 | A * | 2/1967 | Littlewood | 418/189 |
| 3,817,665 | A * | 6/1974 | Myers | 418/189 |
| 4,097,206 | A * | 6/1978 | Schonherr | 418/78 |
| 4,130,383 | A * | 12/1978 | Moinuddin | 418/78 |
| 4,569,646 | A * | 2/1986 | Soeters, Jr. | 418/95 |
| 4,770,617 | A * | 9/1988 | Hertell | 418/77 |
| 5,118,268 | A * | 6/1992 | Crisenbery et al. | 418/189 |
| 6,042,352 | A * | 3/2000 | Halter et al. | 418/189 |
| 6,210,138 | B1 * | 4/2001 | Cortez | 418/132 |
| 7,165,955 | B2 * | 1/2007 | Enzaka et al. | 418/171 |
| 7,479,000 | B2 * | 1/2009 | Klassen | 418/206.5 |
| 7,488,163 | B2 * | 2/2009 | Enzaka et al. | 418/190 |
| 2002/0054822 | A1 * | 5/2002 | Watanabe et al. | 418/171 |

FOREIGN PATENT DOCUMENTS

| | | | |
|---|---|---|---|
| EP | 0 769 104 | B1 | 4/1997 |
| JP | 56151294 | A | 11/1981 |
| JP | 56151295 | A * | 11/1981 |
| JP | 56156485 | A * | 12/1981 |
| JP | H10502715 | A | 3/1998 |

* cited by examiner

*Primary Examiner* — Mary A Davis
(74) *Attorney, Agent, or Firm* — MacMillan, Sobanski & Todd, LLC

(57) ABSTRACT

A hydraulic device has an inlet side and an outlet side and includes two meshing cogwheels. Each cogwheel has external oblique teeth and is arranged between an inlet side and an outlet side. At least one control groove is provided on an end side of the cogwheels. The control groove periodically produces a pressure equalizing connection during the rotation of the cogwheels.

12 Claims, 3 Drawing Sheets

GEAR PUMP WITH PRESSURE RELIEF GROOVE

CROSS-REFERENCE TO RELATED APPLICATIONS

This application is a continuation of German Patent Application No. 20 2006 014 930.9 filed Sep. 28, 2006, the disclosure of which is incorporated herein by reference.

BACKGROUND

Various embodiments of hydraulic device are described herein. IN particular, the embodiments described herein relate to an improved hydraulic device having an inlet side and an outlet side, the hydraulic device including two meshing cogwheels.

Generally, cogwheels in a gear run distinctly more quietly if, apart from the quality of the cogwheel and a good mounting (distance between axles, bearing play, etc.), as great an overlap ratio as possible is achieved. Therefore, attempts are made to use devices in which at least two teeth of one cogwheel are always in engagement simultaneously with two teeth of the other cogwheel during the rotation of the meshing cogwheels.

In addition to optimizing the noise, the efficiency is of crucial importance in hydraulic external cogwheel pumps. In order to achieve a good mechanical and volumetric efficiency, the external diameter of the cogwheels and the distance between their axles are to be selected so that an optimum ratio of cogwheel diameter to (radial) tooth length is guaranteed. This leads to designing the external diameter of the cogwheels so as to be small. However, a small external diameter of the cogwheels limits the maximum number of teeth. In cogwheels with straight teeth, the small number of teeth does not allow a permanent contact in many cases between two pairs of teeth. In order to nevertheless make a double contact possible, it is therefore necessary to provide oblique teeth having a sufficient inclination of the teeth. The advantages of oblique teeth compared with straight teeth additionally include smoother running and a smaller noise development, because each pair of teeth runs with a continuous transition in and out of engagement and therefore the transmission of the torque runs more smoothly. In addition, a greater force can be transmitted compared with a straight toothed wheel of the same size, because the working surfaces of the teeth are larger. However, it is to be noted that with greater angles of inclination, the axial forces on the cogwheels become greater, which may have a detrimental effect on the lifespan of the bearings.

Even with an optimum design of the meshing cogwheels, further influences are additionally involved in hydraulic devices through the operating medium, which have a negative effect on the noise development and the efficiency. The typical pressure pulsations in hydraulic cogwheel pumps, which are principally dependent on the number of teeth, the pressure difference between the inlet side and outlet side, and dynamic local pressure differences, may lead to a rebounding or vibrating of the teeth and therefore both to an undesired noise development and also to an unnecessary fluid reflux from the outlet side to the inlet side of the pump.

A hydraulic device including two meshing cogwheels, each cogwheel having external oblique teeth and being arranged between an inlet side and an outlet side is known from EP 0 769 104 B1. Excess pressure cut-outs (control grooves) and fluid supply cut-outs are provided on both end sides of the cogwheels, these cut-outs being respectively offset with respect to each other according to the oblique teeth gap. The excess pressure cut-outs are permanently connected with intermediate spaces between the teeth of the two cogwheels. Through this, fluid shall be able to escape to the outlet side from the intermediate spaces which become smaller during the rotation of the cogwheels, in order to avoid a fluid reflux to the inlet side.

SUMMARY

The present application describes various embodiments of an optimized hydraulic device with meshing cogwheels particularly optimized with regard to smooth running and noise development.

In one embodiment, a hydraulic device has an inlet side and an outlet side and includes two meshing cogwheels. Each cogwheel has external oblique teeth and is arranged between an inlet side and an outlet side. At least one control groove is provided on an end side of the cogwheels. The control groove periodically produces a pressure equalizing connection during the rotation of the cogwheels.

According to the invention a hydraulic device has an inlet side and an outlet side. The hydraulic device includes two meshing cogwheels, each cogwheel having external oblique teeth and being arranged between the inlet side and the outlet side. At least one control groove is provided on an end side of the cogwheels. The control groove periodically produces a pressure equalizing connecting during rotation of the cogwheels. The pressure equalizing connection which is produced by the control groove makes it possible to equalize pressure differences and pressure fluctuations. However, in order to further guarantee the functioning of the hydraulic device, the additional flow path must not affect too strongly the hydraulic flow of the device which was originally provided, i.e. the loss of volume flow is to be restricted accordingly. The hydraulic device therefore does not provide a permanent pressure equalizing connection, but rather one which recurs periodically, so that a continuous bypass flow is avoided. By suitable positioning and design of the control groove, a sufficiently good volumetric efficiency can still be achieved.

A particularly advantageous possibility for the periodic production of the pressure equalizing connection is provided by a construction in which the control groove is able to be completely covered by a tooth of the oblique teeth. In this way, an opening and closing of the pressure equalizing connection is achieved which is dependent on the rotation speed.

According to a one embodiment of the invention, the control groove is connected with the outlet side, so that the fluid pressure can be increased in a particular region the control groove is connected with.

In the case of a hydraulic external cogwheel pump with double contact, if, therefore, at any time at least two mutual contact points of the cogwheels exist whilst the cogwheels are rotating, a particularly smooth running behavior is produced through a construction in which the pressure equalizing connection leads, during its existence, to an intermediate space between the cogwheels, which initially lies between the two contact points and, as the rotation of the cogwheels continues, comes into connection which the inlet side. In this way, a substantially constant pressure is made possible between the teeth over defined periods of time, whilst maintaining the double contact.

DETAILED DESCRIPTION

Figure 1:
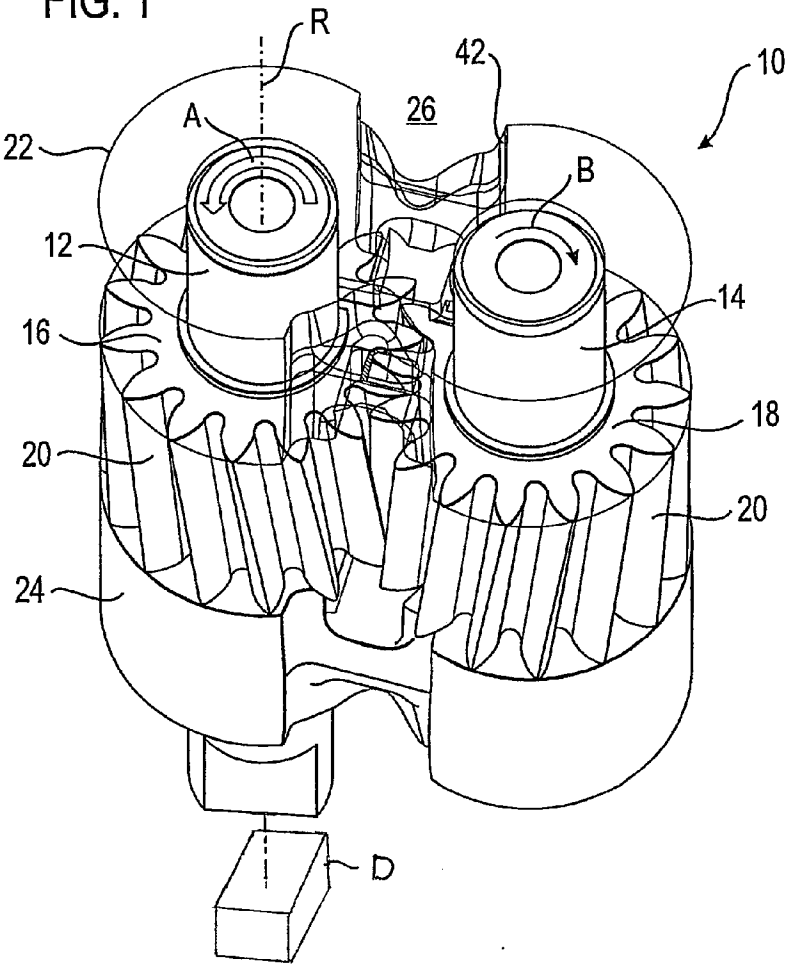
FIG. 1 shows a perspective view of a cogwheel pump without a housing and with a transparent upper bearing support.
Figure 2:
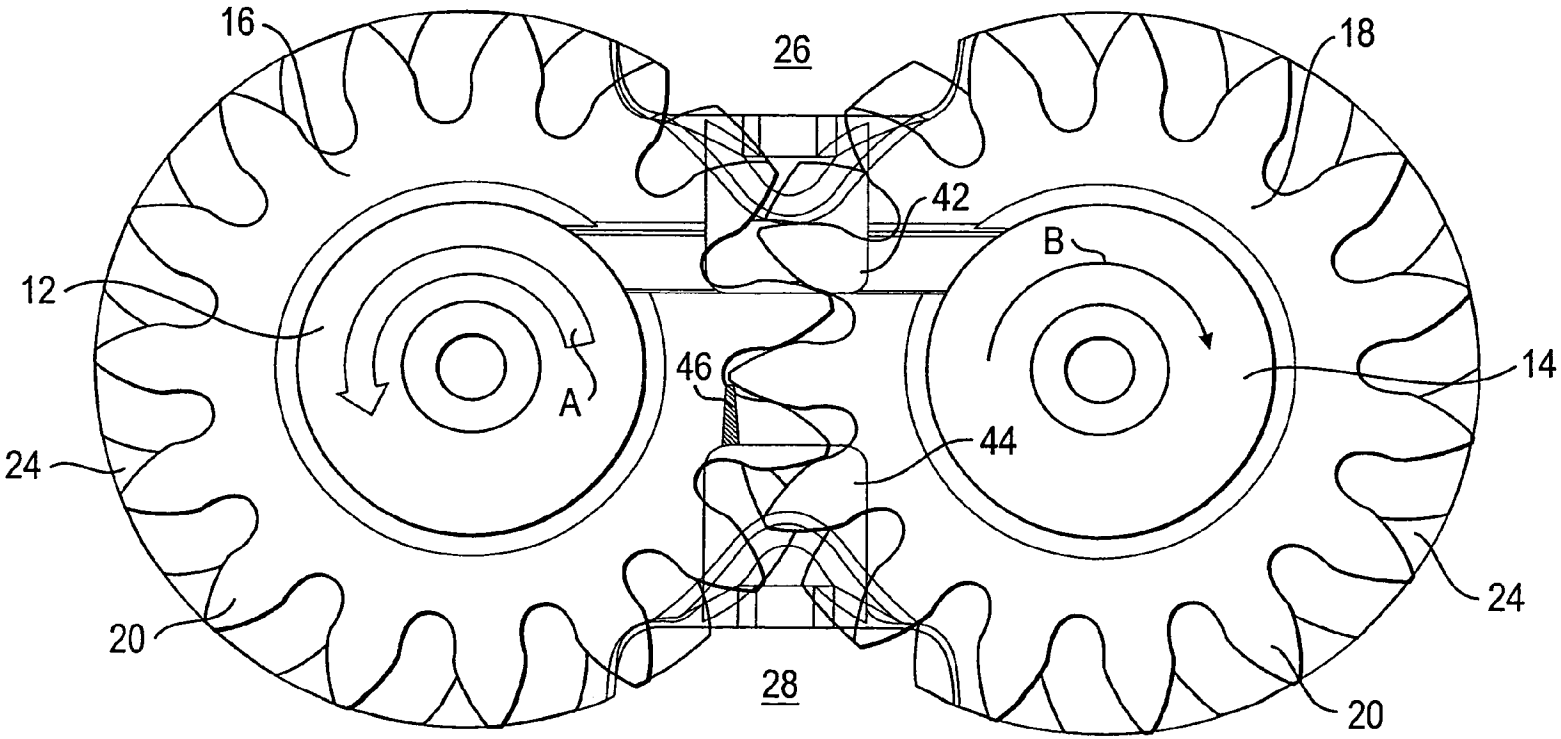
FIG. 2 shows a top view of the pump of FIG. 1.

In FIGS. 1 and 2 a hydraulic cogwheel pump 10 without a housing is shown. The pump 10 comprises two rotatable shafts 12, 14 with cogwheels 16, 18 mounted non-rotatably thereon. The cogwheels 16, 18 can also be constructed integrally with the respective shaft 12 and 14. The cogwheels 16, 18 have external oblique teeth, which are oppositely inclined with respect to the rotation axis R. In the illustrated example embodiment the oblique teeth of the left-hand cogwheel 16 in FIG. 1, which is designated below as the first cogwheel 16, wind to the left, and those of the right-hand cogwheel (second cogwheel) wind to the right. The sides of the teeth 20 of the sets of teeth have the form of involutes.

The two shafts 12, 14 are rotatably mounted in bearing supports 22, 24, which are designated as upper bearing support 22 and lower bearing support 24 in accordance with the installation position of the pump 10 shown in FIG. 1. The first shaft 12 is extended downwards and is coupled to a drive D, shown schematically in FIG. 1. The drive D drives the first cogwheel 16, which is mounted on the first shaft 12, in the direction of arrow A. The second cogwheel 18, meshing with the first cogwheel 16, rotates in the opposite direction (arrow B). This rotation of the cogwheels 16, 18 causes fluid to be conveyed in a known manner from a suction region 26 of the pump 10 on the inlet side to a pressure region 28 on the outlet side. The inclination of the teeth 20 of the two cogwheels 16, 18 effects the ends of teeth 20 (on the drive side) facing the lower bearing support 24 lead the upper ends of the teeth 20 when the cogwheels 16, 18 rotate in the directions of the arrows A and B, respectively.

Figure 3:
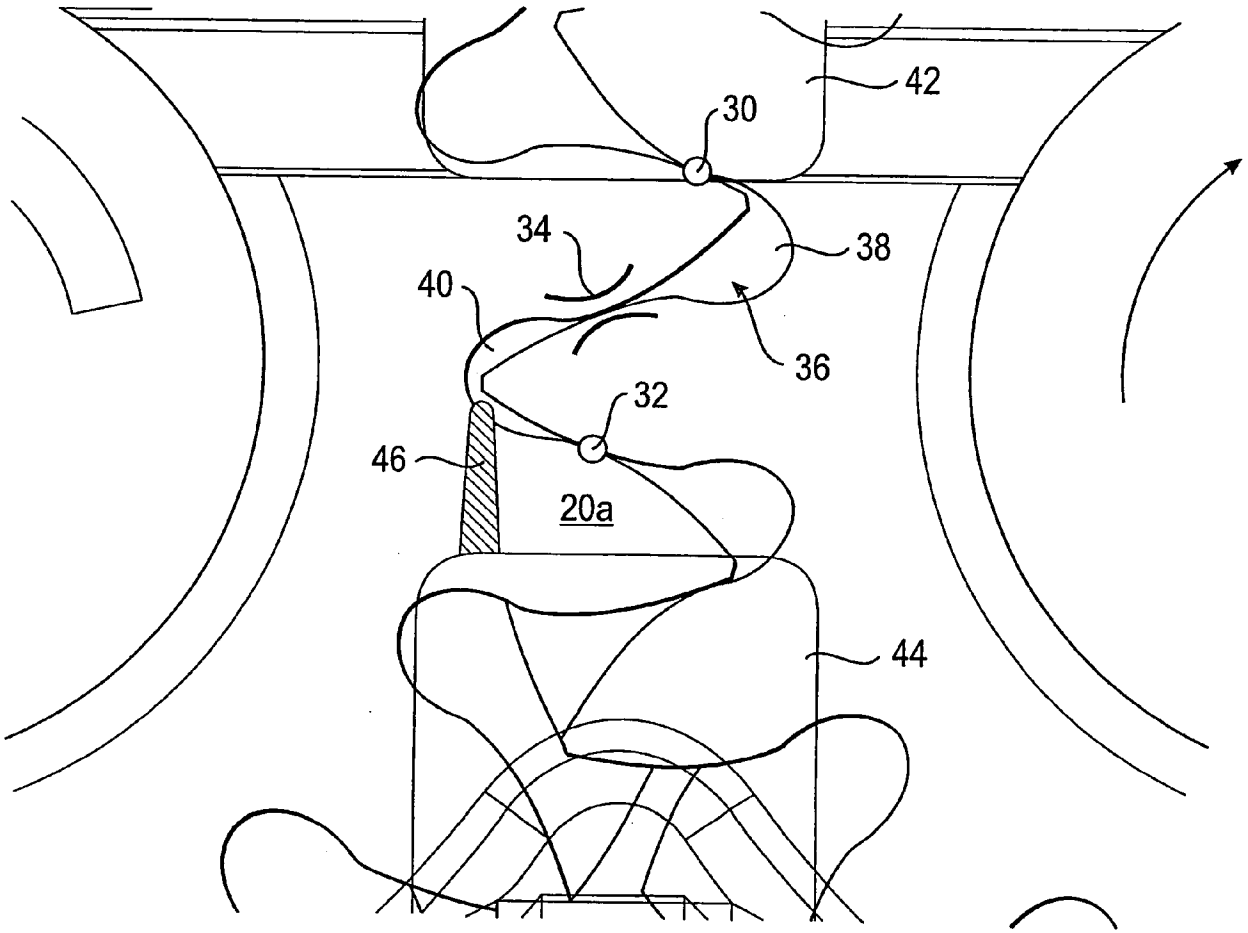
FIG. 3 shows an enlarged illustration of the engagement region of the cogwheels of the pump.

During the rotation of the cogwheels 16, 18, at least two teeth 20 of the first cogwheel 16 are in engagement at any time with two teeth 20 of the second cogwheel 18. In FIG. 3, which shows the engagement region of the cogwheels 16, 18 in an enlarged view, the corresponding contact points 30, 32 are marked. There is therefore always a contact point 30 which is leading with respect to the rotation direction, and a contact point 32 which is following. As soon as the leading contact point 30 no longer exists, the contact point 32, which up to then was following, becomes the next leading contact point, etc. The bulges of the meshing teeth 20 regularly form a narrow 34 between the two contact points 30, 32. The narrow 34 divides a temporary intermediate space 36 between the cogwheels 16, 18, which is delimited by the two contact points 30, 32, into two partial spaces 38, 40.

As indicated in FIGS. 1 and 2, two cut-outs 42, 44 are formed both in the upper bearing support 22 and also in the lower bearing support 24 on the inner side facing the cogwheels 16, 18, these cut-outs being designated below as suction cut-out 42 and pressure cut-out 44. The suction cut-out 42 is connected with the suction region 26, and the pressure cut-out 44 is connected with the pressure region 28 of the pump 10. Depending on whether a tooth gap is covered by one of the cut-outs 42 or 44 (in the upper or lower bearing support 22 or 24), fluid can flow into or out from the gap.

The control groove 46 provided according to the invention, which extends in the upper bearing support 22 from the pressure cut-out 44, constitutes an exception. The position and the dimensions of the control groove 46 are matched precisely to the geometric conditions of the meshing cogwheels 16, 18, as can be seen from the following functional description of the control groove 46 with reference to FIG. 3.

FIG. 3 shows a "snapshot" of the rotation of the cogwheels 16, 18, in which the leading contact point 30 lies at the boundary to the suction cut-out 42, whilst the following contact point 32 lies in the region between the two cut-outs 42, 44. At this moment, the control groove 46 provides for a flow connection between the pressure cut-out 44 and the partial space 40 of the intermediate space 36 adjoining the following contact point 32. The control groove 46 provides a pressure equalizing connection and makes possible a control flow of the fluid, which leads principally from the upper bearing support 22 along the teeth 20 to the lower bearing support 24. As no control groove or suchlike is provided in the lower bearing support 24, no leakage flow occurs there. In this way, a constant pressure is kept in the intermediate space 36

When the cogwheels 16, 18 rotate further, the contact point 30, which up until then was leading, disappears so that a certain amount of fluid arrives directly from the intermediate space 36 into the suction region 42 of the pump 10. In addition, at this moment a flow connection exists between the pressure region 28—via the control groove 46, the first partial space 40, the narrow point 34 and the second partial space 38 which now no longer closed off—and the suction region 26 of the pump 10. The narrow point 34 in fact acts here like a throttle for the fluid, with its throttle effect being dependent on the play of the cogwheels 20, i.e. the less play the cogwheels 16, 18 have, the greater the throttle effect; nevertheless, a type of "short circuit" exists at this moment between the inlet side and the outlet side of the pump 10.

Firstly, however, the short circuit does not exist continuously, but only for a very short time, because the control groove 46 is immediately thereafter covered completely by a tooth 20*a* of the driving first cogwheel 16; secondly, the control groove 46, which is of relatively small construction, only allows a small volume throughput. Therefore, in the short period of time in which the pressure equalizing connection exists, just so much fluid flows through the control groove 46 that on the one hand a pressure equalization takes place on both sides of the narrow point 34, whereby a rebound or vibration of the teeth 20 of the second cogwheel 18 is prevented; on the other hand, however, the efficiency of the pump 10 is not critically impaired by the fluid reflux to the inlet side.

The process described above is repeated cyclically during the rotation of the cogwheels 16, 18, i.e. a bypass is produced periodically by the control groove 46—with a frequency determined by the rotation speed and number of teeth 20 of the set of teeth. The duration of each period depends on the spacing of the teeth 20 and of their width in the peripheral direction.

The control groove 46 does not necessarily have to be formed in one of the bearing supports 22, 24. It is also possible to provide each tooth 20 of the first cogwheel 16 with a control groove on the end side, the size and radial position of which corresponds to the control groove 46 described above.

Further embodiments of the invention may have, inter alia, one or more of the following deviations:

the oblique teeth of the driving first cogwheel 16 wind to the left; those of the driven second cogwheel 18 wind to the right;

the control groove 46 is not formed on the side of the driving first cogwheel 16, but rather on the side of the driven second cogwheel 18 and is able to be covered completely by a tooth 20 of the second cogwheel 18;

the control groove 46 is not formed in the upper bearing support 22, but rather in the lower bearing support 24;

at least two control grooves 46 are provided in one of the bearing supports 22, 24;

at least one control groove 46 is provided in the upper bearing support 22 and at least one control groove 46 is provided in the lower bearing support 24.

In all cases, the control groove 46 extends respectively from one of the pressure cut-outs 44.

The following table gives an overview of alternate embodiments of the invention. The embodiment shown in FIGS. 1 to 3 corresponds to Combination 2.

| Combination | Winding direction of the oblique teeth of the driving cogwheel | Number of control grooves | Cogwheel whose teeth cover the control groove(s) | Position of the control groove(s) (bearing support) |
|---|---|---|---|---|
| 1 | left | 1 | driving | lower |
| 2 | left | 1 | driving | upper |
| 3 | left | 2 | driving | lower |
| 4 | left | 2 | driving | upper |
| 5 | left | 1 | driven | lower |
| 6 | left | 1 | driven | upper |
| 7 | left | 2 | driven | lower |
| 8 | left | 2 | driven | upper |
| 9 | left | 2 | driving, driven | lower, upper |
| 10 | left | 2 | driving, driven | lower, upper |
| 11 | right | 1 | driving | lower |
| 12 | right | 1 | driving | upper |
| 13 | right | 2 | driving | lower |
| 14 | right | 2 | driving | upper |
| 15 | right | 1 | driven | lower |
| 16 | right | 1 | driven | upper |
| 17 | right | 2 | driven | lower |
| 18 | right | 2 | driven | upper |
| 19 | right | 2 | driving, driven | lower, upper |
| 20 | right | 2 | driving, driven | lower, upper |

Since both the position and the dimensions of the control groove 46 need to be very precise in order to avoid unnecessary leakages, the control groove 46 is preferably produced by laser beam cutting. This kind of manufacturing is fast and suitable for mass production. A further advantage is that no wear of the tools occurs. The likewise very precisely designed bearing supports 22, 24 are not affected by a subsequent laser treatment, so that this working step can be performed "off-line" as the last step in the manufacturing process of the hydraulic device.

The principle and mode of operation of the hydraulic device have been described in its various embodiments. However, it should be noted that the hydraulic device described herein may be practiced otherwise than as specifically illustrated and described without departing from its scope.

The invention claimed is:

1. A hydraulic device having an inlet side and an outlet side, the hydraulic device comprising:

two meshing cogwheels, each cogwheel having external oblique teeth and being arranged between the inlet side and the outlet side;

a bearing support provided on an end side of the two meshing cogwheels;

an elongated control groove provided in the bearing support and connected only with the outlet side, the elongated control groove periodically producing a pressure equalizing connection during rotation of the cogwheels;

wherein the elongated control groove is longitudinal in shape and has a long side;

wherein the long side is substantially perpendicular to a line extending from an axis of rotation of a first cogwheel of the two meshing cogwheels to a center of a longitudinal axis of the elongated control groove;

wherein the elongated control groove has a longitudinal length and a width, the length being greater than the width; and wherein the elongated control groove has a length smaller than a chordal thickness of a tooth of the first cogwheel such that the elongated control groove is covered by each tooth of the first cogwheel as the teeth are caused to pass over the elongated control groove when the first cogwheel is caused to rotate.

2. The hydraulic device according to claim 1, wherein during the rotation of the cogwheels, at any time at least two mutual contact points of the cogwheels exist, the pressure equalizing connection, during its existence, leading to an intermediate space between the cogwheels, the intermediate space initially lying between the two contact points and, as the rotation of the cogwheels continues, coming into connection with the inlet side.

3. The hydraulic device according to claim 1, further comprising a drive for one of the cogwheels arranged on an end side of the cogwheels, the elongated control groove being provided on the end side which faces the drive.

4. The hydraulic device according to claim 1, further comprising a drive for one of the cogwheels arranged on an end side of the cogwheels, the elongated control groove being provided on the end side which faces away from the drive.

5. The hydraulic device according to claim 1, wherein the elongated control groove is formed on a surface of the bearing support.

6. The hydraulic device according to claim 5, wherein the elongated control groove extends from a pressure cut-out of the bearing support.

7. The hydraulic device according to claim 6, wherein the two meshing cogwheels include the first cogwheel and a second cogwheel; and wherein the first cogwheel is connected to a drive which rotates the first cogwheel.

8. The hydraulic device according to claim 7, wherein the second cogwheel has an external diameter; and wherein the longitudinal axis of the elongated control groove extends tangentially to the external diameter of the second cogwheel.

9. The hydraulic device according to claim 1, wherein the bearing support provided on an end side of the two meshing cogwheels is the first of a pair of bearing supports, a second of the pair of bearing supports is provided on an opposite end side of the two meshing cogwheels from the first bearing support; and wherein the elongated control groove is provided in each of the bearing supports.

10. The hydraulic device according to claim 1, wherein the elongated control groove is formed by laser beam cutting.

11. The hydraulic device according to claim 1, wherein the elongated control groove extends inwardly from the outlet side.

12. A hydraulic device having an inlet side and an outlet side, the hydraulic device comprising:

two meshing cogwheels, each cogwheel having external oblique teeth and being arranged between the inlet side and the outlet side;

a bearing support provided on an end side of the two meshing cogwheels;

a single elongated control groove provided in the bearing support and connected with the outlet side, the elongated control groove periodically producing a pressure equalizing connection during rotation of the cogwheels;

wherein the elongated control groove is longitudinal in shape and has a long side;

wherein the long side is substantially perpendicular to a line extending from an axis of rotation of a first cogwheel of the two meshing cogwheels to a center of a longitudinal axis of the elongated control groove;

wherein the elongated control groove has a longitudinal length and a width, the length being greater than the width; and wherein the elongated control groove has a length smaller than a chordal thickness of a tooth of the first cogwheel such that the elongated control groove is covered by each tooth of the first cogwheel as the teeth are caused to pass over the elongated control groove when the first cogwheel is caused to rotate.

* * * * *